US007208670B2

(12) United States Patent
Sim et al.

(10) Patent No.: US 7,208,670 B2
(45) Date of Patent: Apr. 24, 2007

(54) SYSTEM TO ENABLE THE USE OF WHITE KEYS OF MUSICAL KEYBOARDS FOR SCALES

(75) Inventors: Wong Hoo Sim, Singapore (SG); Phoei Min Paul Seow, Singapore (SG); Kok Liang Lim, Singapore (SG)

(73) Assignee: Creative Technology Limited, Singapore (SG)

( * ) Notice: Subject to any disclaimer, the term of this patent is extended or adjusted under 35 U.S.C. 154(b) by 305 days.

(21) Appl. No.: 10/442,708

(22) Filed: May 20, 2003

(65) Prior Publication Data

US 2004/0231500 A1 Nov. 25, 2004

(51) Int. Cl.
*A63H 5/00* (2006.01)
*G04B 13/00* (2006.01)
*G10H 7/00* (2006.01)

(52) U.S. Cl. ..... 84/609; 84/615; 84/649

(58) Field of Classification Search ..... 84/600, 84/609–613, 615–616, 626, 718–720, 743–745
See application file for complete search history.

(56) References Cited

U.S. PATENT DOCUMENTS

| | | | | |
|---|---|---|---|---|
| 4,513,650 A | | 4/1985 | Nagasaka et al. | |
| 5,099,738 A | | 3/1992 | Hotz | |
| 5,129,303 A | | 7/1992 | Coles | |
| 5,619,003 A | * | 4/1997 | Hotz | 84/615 |
| 6,201,178 B1 | * | 3/2001 | Shinsky | 84/613 |
| 6,448,486 B1 | * | 9/2002 | Shinsky | 84/613 |
| 6,867,359 B2 | * | 3/2005 | Koseki et al. | 84/615 |

OTHER PUBLICATIONS

Lengeling, Gerhard and Chris Adam, "C-Lab Notator/Creator MIDI Sequence & Score Edit/Printout Management System for ATAR User's Manual," 1987-1989, pp. 66-67.

* cited by examiner

*Primary Examiner*—Marlon Fletcher
(74) *Attorney, Agent, or Firm*—Blakely, Sokoloff, Taylor & Zafman; Stephen M. De Klerk

(57) ABSTRACT

A method for the use of the white keys of a musical keyboard such as a MIDI keyboard for the playing a selected scale whereby all while keys of the keyboard are remapped to the selected scale such that adjacent keys of the keyboard can be used to play adjacent notes of the selected scale. There is also disclosed a method for providing a functional aspect to at least one black key of a musical keyboard such as a MIDI keyboard, wherein upon a key of the keyboard being pressed, a first check is conducted to determine if a user has activated the selected scale setting; and if the selected scale function has been activated, a second check is conducted to determine if the key is a black key or a white key. If the key is a black key a second lookup table is checked based on a MIDI message for the black key to determine a corresponding functional aspect corresponding to the black key.

14 Claims, 4 Drawing Sheets

SYSTEM TO ENABLE THE USE OF WHITE KEYS OF MUSICAL KEYBOARDS FOR SCALES

FIELD OF THE INVENTION

This invention relates to a system to enable the use of the white keys of musical keyboards for playing music according to different scales, and to the use of black keys of a MIDI keyboard in performing different functional aspects.

Definitions

Throughout this specification reference to "alphanumeric" is to be taken as including any symbols that may be found on the keys of a computer keyboard including regional or national alphabets, scripts and symbols. For example, a so-called "western" keyboard may include the following alphanumeric keys:

alpha keys a to z;

numeric keys 0 to 9;

function keys including dedicated function keys such as, for example, F1 to F12, and such keys as Internet access keys;

instructional keys such as, for example, "Esc", "Enter", "Ctl", "Shift", "Tab", "Caps Lock", "Delete", "Insert", "Home", "Page Up", "Page Down", "End", "Num Lock";

cursor control keys;

and the "Shift" function of all of them.

BACKGROUND TO THE INVENTION

The white keys on a musical keyboard such as a MIDI keyboard play the standard 12-semitone scale (C Major music scale). The black keys play the sharps and flats of the music scale. There are different forms of scales playable on MIDI keyboards. All but the C major scale involve use of at least one of the black keys. Beginners sometimes find the use of the black keys difficult.

Also, pentatonic scales are often used in Asian music. The ability to easily play pentatonic scales exists in traditional 'Asian' instruments but not on MIDI keyboards. When a person with little music background plays on the 7-note white keys or black keys of a traditional 7-tone MIDI keyboard, it is very difficult for them to play rhythmic and nice-sounding music. Pentatonic instruments, with their five-note scale, are easy to play and learn. A person with little music background can quite easily play melodiously and rhythmically.

Also, on most MIDI keyboards each key has only one function—to play a designated, predetermined note. Function keys are provided to allow a user certain functionality when a particular function key is activated. Such function keys are limited in number.

SUMMARY OF THE INVENTION

In accordance with one aspect of the invention there is provided a system for the use of white keys a musical keyboard to play in accordance with a designated scale using only the white keys, whereby upon the designated scale being designated and a white key pressed, all white keys of the musical keyboard are remapped to the designated scale such that white keys of the musical keyboard can be used to play in accordance with the designated scale. The musical keyboard may be a MIDI keyboard. The designated scale may be one of a major scale, a minor scale, a melodic minor scale, a harmonic minor scale, a pentatonic scale, a chromatic scale, a jazz scale, a rock scale, and a blues scale. When the designated scale is designated, all black keys are blocked from being able to be used to play their normal note and a remapped to have a functional aspect.

Preferably, upon a white key being pressed, a first check is conducted to determine if a user has selected to play using the white keys only. If the white key only function has been selected, a further check is conducted to determine which form of scale has been selected. A first lookup table is then checked based on a MIDI message corresponding to the pressed white key to determine a corresponding music note, according to the designated scale, for the white key. Upon the corresponding music note being determined, a sound card is instructed to produce the corresponding music note. All remaining notes on the keyboard are then remapped to accord to the designated scale.

If a black key is pressed, a second lookup table is checked based on a MIDI message corresponding to the black key to determine a corresponding functional aspect corresponding to the black key. Upon the corresponding functional aspect being determined, a sound card is instructed to produce the corresponding functional aspect.

Preferably the corresponding functional aspect is one of rhythm, sound effect, or instrumental fill-in. The rhythm may be one or more of drums, bass, chords, backing harmony and countermelody. The sound effect may be one or more of sound of applause, sound of waves lapping on a sea-shore, sound of a waterfall, sound of a rushing stream, sound of wind, sounds of matching instruments and bird calls. The instrumental fill in may be drum roll, piano fill, guitar riff, cymbal crash, gong crash, and tam tam crash. The black keys may be arranged so that a first set of black keys are for a first functional aspect, a second set of black keys are for a second functional aspect, and a third set of black keys are for a third functional aspect. The first, second and third functional aspects may be selected from a rhythm, sound effect, and instrumental fill-in.

The corresponding functional aspect may be pre-programmed and/or may be from user input.

A predetermined set of black keys may have their corresponding functional aspect pre-programmed, and all remaining black keys may be able to have their corresponding functional aspect input by a user.

In an alternative form, the present invention provides a method for providing a functional aspect to at least one black key of a musical keyboard, wherein upon a black key being pressed, a first check is conducted to determine if a user has selected a predetermined setting such as, for example, a designated scale such that the black key can have the functional aspect. If the predetermined setting has been selected, a second check is conducted to determine if the key is a black key or a white key. If the key is a black key a second lookup table is checked based on a message corresponding to the black key to determine a corresponding functional aspect corresponding to the black key.

The musical keyboard may be a MIDI keyboard, and the message may be a MIDI message. Upon the corresponding functional aspect being determined, a sound card may be instructed to produce the corresponding functional aspect.

The corresponding functional aspect may be rhythm, sound effect, or instrumental fill-in. The rhythm may be drums, bass, chords, backing harmony or countermelody. The sound effect may be sound of applause, sound of waves lapping on a sea-shore, sound of a waterfall, sound of a rushing stream, sound of wind, and bird calls. The instrumental fill-in may be drum roll, piano fill, guitar riff, cymbal crash, gong, sounds of matching instruments, or tam tam.

The corresponding functional aspect may be pre-programmed and/or may be from user input. A predetermined set of black keys may have their corresponding functional aspect pre-programmed; and all remaining black keys may be able to have their corresponding functional aspect input by a user.

DESCRIPTION OF THE DRAWINGS

In order that the invention maybe readily understood and put into practical effect, there shall now be described by way of non-limitative example only a preferred embodiment of the present invention, the description being with reference to the accompanying illustrative drawings in which.

DESCRIPTION OF PREFERRED EMBODIMENT

Figure 1:
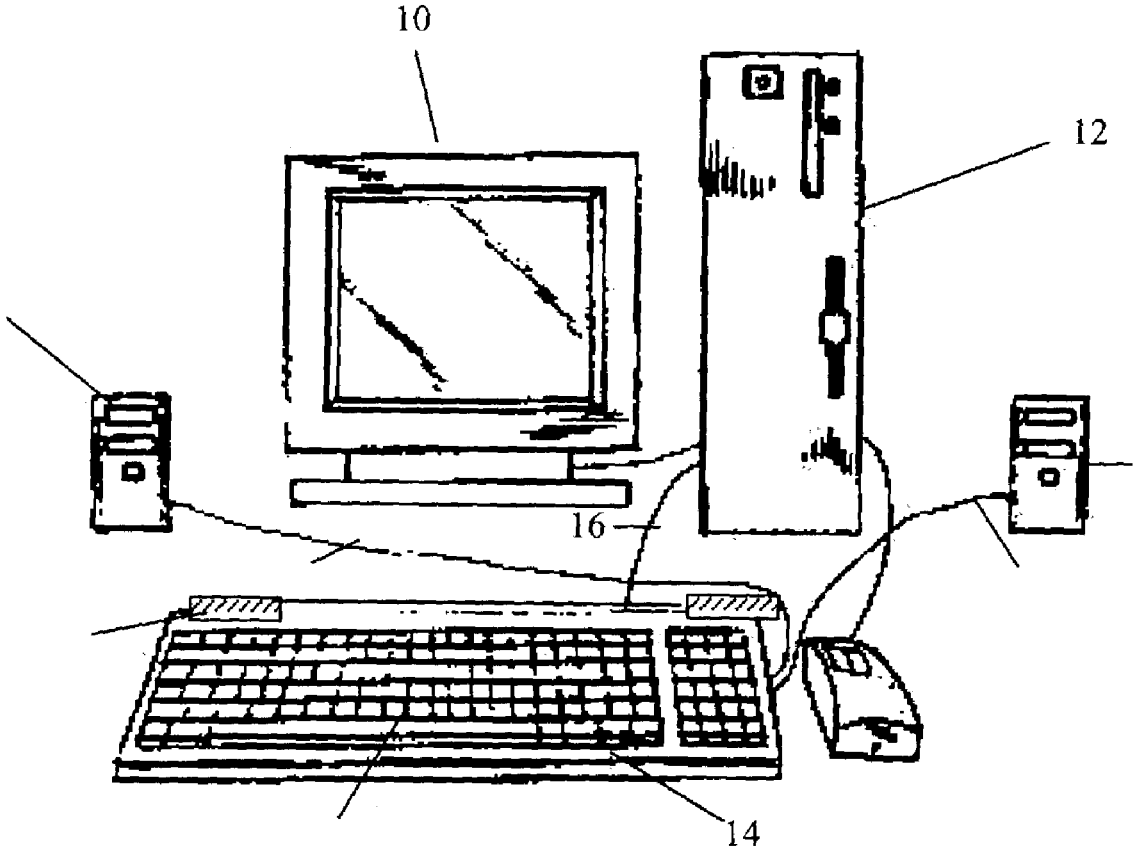
FIG. 1 is a schematic illustration of a computer system using the present invention.

To first refer to FIG. 1, there is shown a computer system including monitor 10, host PC 12 and keyboard 14. Keyboard 14 is shown connected to host PC 12 by a cable 16. Alternatively, a wireless connection may be used. The wireless connection may be by any suitable system including, for example, Bluetooth, or any other radio frequency or infrared system.

Cable 16 is connected to keyboard 14 at one end, and has its other end at least one digital data connector. It is preferred to be only one connector. The connector may be a USB connector or an IEEE 1394 connector, or other suitable digital data transfer connector. In the following description reference will be made to the use of a single USB connector for the sake of convenience. However, there may be two connectors with one connector being for "normal" keyboard functions, and a second connector being for digital audio transfer.

Figure 2:
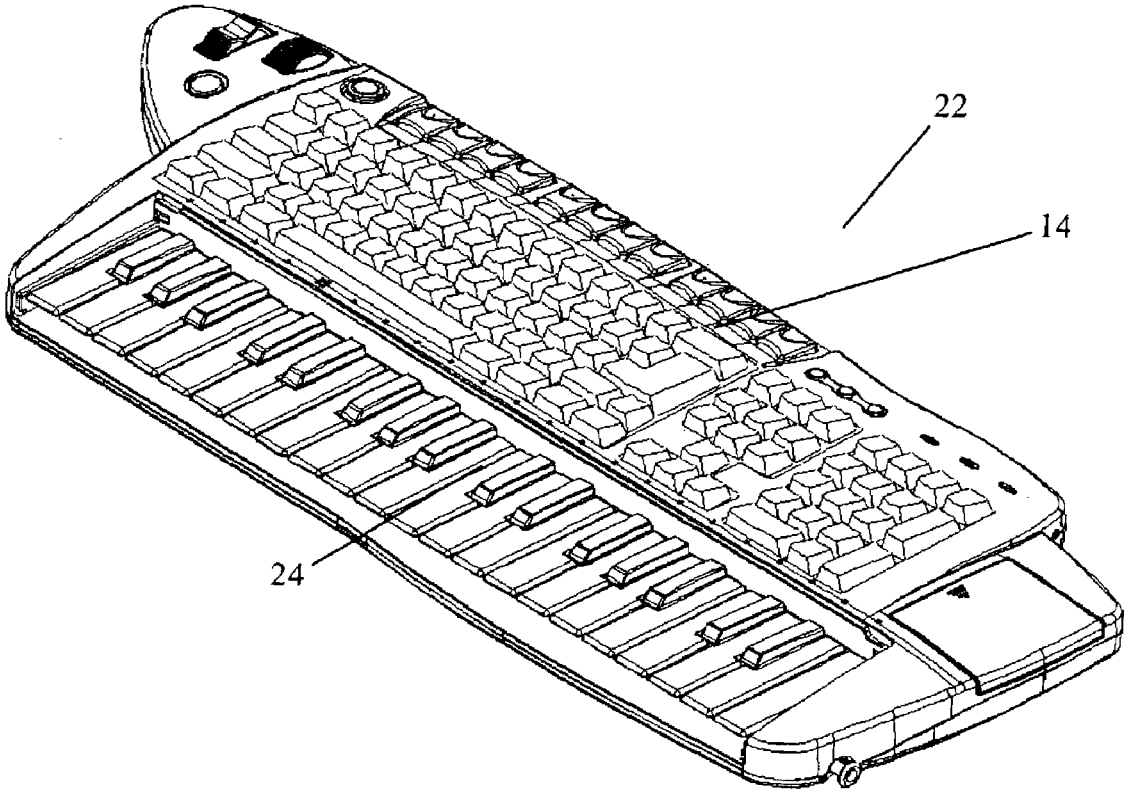
FIG. 2 is a schematic illustration of the keyboard of FIG. 1 with an integrated music keyboard.

The keyboard 14 may be as shown in FIG. 2—a keyboard 22 having a musical keyboard 24 built-in and integrated with the alphanumeric keyboard 14. This may be in accordance with our earlier application number PCT/SG01/00040, the contents of which are hereby incorporated by reference.

Although MIDI is used, it may also be used for a quasi-MIDI musical keyboard, or any other musical keyboard, or any other musical keyboard operating system.

Figure 3:
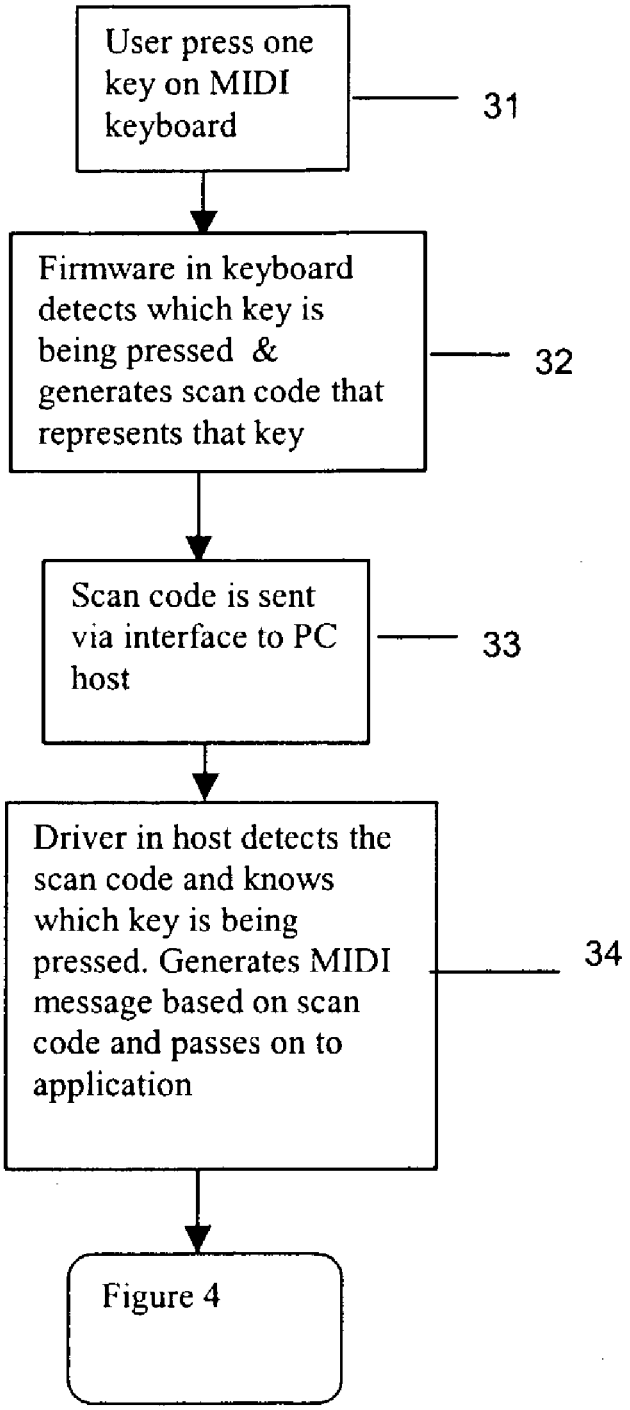
FIG. 3 is a flow chart for a first part of the process of the present invention.
Figure 4:
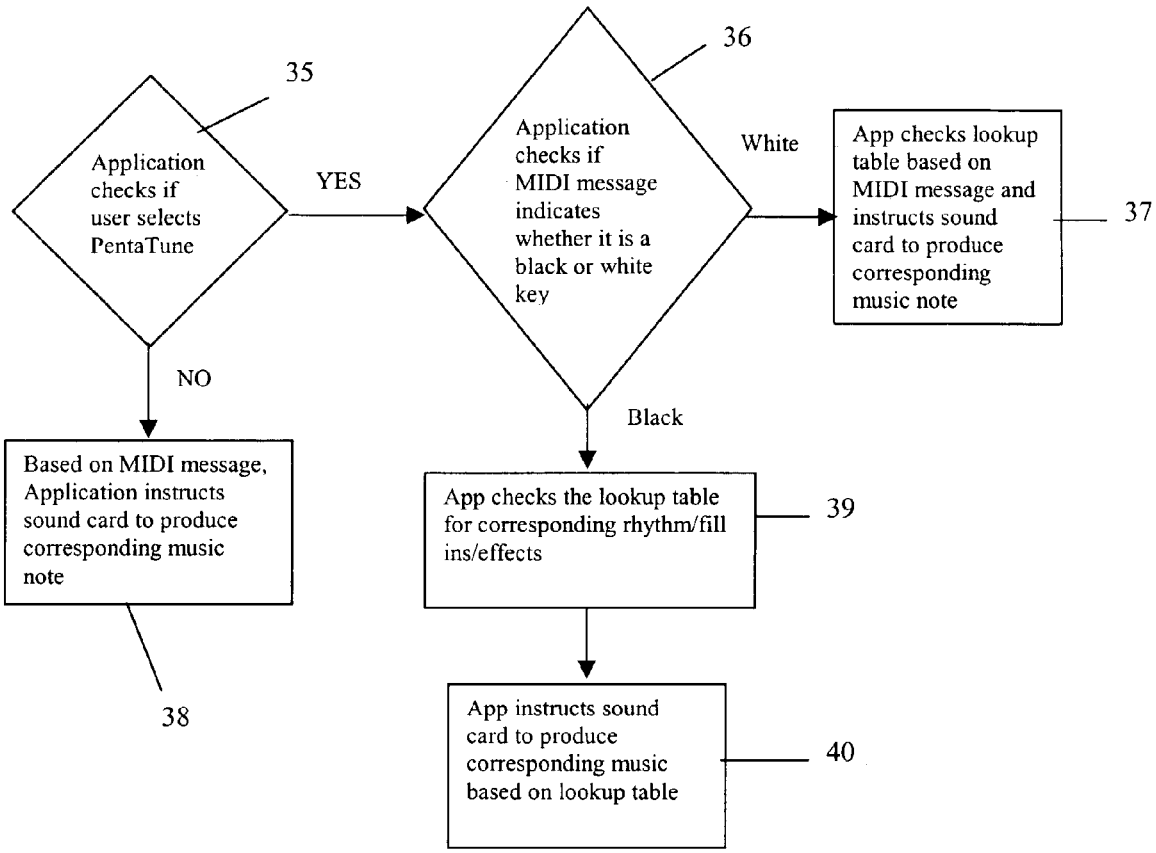
FIG. 4 is a flow chart for a second part of the process of the present invention.

To refer to FIGS. 3 and 4, the present invention provides a software implementation to re-map all white-keys on a musical keyboard such as, for example, a MIDI keyboard or the keyboard 24, to play in accordance with a designated scale. The designated scale may be one of a major scale, a minor scale, a melodic minor scale, a harmonic minor scale, a pentatonic scale, a chromatic scale, a jazz scale, a rock scale, and a blues scale. A function is provided to allow a user to select which scale is to be used. This may be a physical switch, a software menu, at least one icons, or otherwise.

When the designated scale is selected, and a first white key is pressed, the remaining white keys are all remapped to accord to the relevant scale starting on the note corresponding to the white key pressed. If a chromatic scale, all the white keys are remapped to be one semitone apart. If a major scale, the white keys are remapped to follow 12-semitone standard major scale starting on the pressed key. For example, if the white key pressed is an E, and a major scale has been selected, the white keys are remapped to play only E, F#, G#, A, B, C# and D#. If a pentatonic scale (C, D, E, G, A) is selected, all white keys are remapped to be only C, D, E, G and A. Therefore, a user can press five consecutive white keys to play the pentatonic scale C, D, E, G, A, and does not need to locate and strike the keys for the "normal" notes C, D, E, G, A in the standard 12 semitone scale.

During the remapping process all black keys are blocked from being able to produce their corresponding musical notes. Different groups of black-keys on the MIDI keyboard are assigned functional aspects. The grouping may be that a first group of approximately one third of the black keys are assigned a first functional aspect, a second group of approximately one third of the black keys are assigned a second functional aspect, and a third group of approximately one third of all black keys are assigned a third functional aspect. The three functional aspects may be rhythm, sound effects, and instrumental fill-ins. These may include one or more of the following sound sets:

| | |
|---|---|
| a. Rhythm | A musical loop which produce the background music such as, for example, drums, bass, chords, backing harmony, countermelody, and so forth. |
| b. Sound Effect | Any sound which is suitable for the given scale in a given style. Such as, for example, applause from audience, waves lapping on a seashore, sound of waterfalls, sound of a rushing stream, bird calls, sound of wind, sounds of matching instruments, and so forth. |
| c. Instrumental fill-ins | A musical phrase which will generate a musical break/turnaround for the given scale style such as, for example, guitar rift, piano fill, drum roll, drum fill, cymbal crash, gong crash, tam tam crash, bass line, and so forth. |

With the new remapping, a user may enhance their playing by using the white keys to produce the melody in the designated scale, and pressing various black keys to add in sound effects, fill-ins, and/or rhythm.

To refer to FIGS. 3 and 4, there is illustrated the process when a user has selected a pentatonic scale. However, the process is the same for all forms of scale.

When a user presses a key on a MIDI keyboard (31), the application in the keyboard processor detects which key is pressed and generates a scan code that represents that particular key (32). The scan code is sent to the host (be it a PC, laptop, or the like) via an interface (33). The host may be separate from the keyboard, or may be built-in to the keyboard. The driver in the host detects the scan code and therefore knows which key is being pressed. The driver generates a MIDI message based on the scan code and passes it to the functional application for the MIDI keyboard (34).

Upon receipt of the message the application checks to determine if the user has previously selected pentatonic scale (35). The user may select pentatonic scale by activating a preset function key or by activation of the relevant software function from a displayed menu item, displayed icon, or otherwise.

If the user hasn't selected pentatonic scale, based on the MIDI message the application instructs the sound card to produce the note required for the particular MIDI key that has been pressed (38).

However, if the user has selected pentatonic scale, the application checks the MIDI message to determine if the key that has been pressed is a black key or a white key (36).

If the key is a white key, the application checks a first lookup table based on the MIDI message to determine the corresponding music note according to the pentatonic scale for the particular key that has been pressed (37), and instructs the sound card to produce that note. All remaining keys are then remapped to accord to the selected pentatonic scale.

If the key pressed is a black key, the application checks a second lookup table based on the MIDI message to determine the rhythm/fill-ins/effect corresponding to the particular key pressed (39), and instructs the sound card to produce the corresponding rhythm/fill-in/effect (40).

All or some of the back keys may be used for the functional aspects. The functional aspects may be preprogrammed, able to be input by a user, or a combination of them. Certain black keys may be preprogrammed with some or all of the remaining black keys being able to be the subject of user input.

The present invention also extends to a computer useable medium computing a computer program code that is configured to cause a processor to execute one or more of the functions as described above; and to a computer system which comprises one or more means for performing one or more functions as described above. The present invention also extends to a keyboard so programmed.

Whilst there has been described in the foregoing description a preferred embodiment of the present invention, it will be understood by those skilled in the technology concerned that many variations or modifications in details of the process of present invention may be made without departing from the present invention.

What is claimed:

1. A method for using white keys of a musical keyboard to play in accordance with a designated scale using only the white keys comprising:

upon a key being pressed, conducting a first check to determine if the designated scale has been designated and, if yes, conducting a second check to determine if the pressed key is a black key or a white key; and upon the designated scale being designated and a white key being pressed, remapping all white keys of the musical keyboard to the designated scale starting from a note corresponding to the white key pressed such that white keys of the musical keyboard can be used to play in accordance with the designated scale, whereby the designated scale is selected from the group consisting of major, minor, melodic minor, harmonic minor, pentatonic, chromatic, jazz, rock and blues.

2. A method as claimed in claim 1, wherein if the key is a white key, checking a first lookup table based on a message corresponding to the white key to determine a corresponding music note according to the pentatonic scale for the white key and a sound card is instructed to produce the corresponding music note.

3. A method as claimed in claim 2, wherein the message is a MIDI message.

4. A method as claimed in claim 1, wherein if the key is a black key, a second lookup table is checked based on a message corresponding to the black key to determine a corresponding functional aspect corresponding to the black key and a sound card is instructed to produce the functional aspect.

5. A method as claimed in claim 4, wherein the message is a MIDI message.

6. A method as claimed in claim 4, wherein the corresponding functional aspect is selected from the group consisting of rhythm, sound effect, and instrumental fill-in.

7. A method as claimed in claim 6, wherein the rhythm is one or more selected from the group consisting of: drums, bass, chords, backing harmony and countermelody.

8. A method as claimed in claim 6, wherein the sound effect is one or more selected from the group consisting of sound of applause, sound of waves lapping on a sea-shore, sound of a waterfall, sound of a rushing stream, sound of wind, and bird calls and matching musical instrumental sounds.

9. A method as claimed in claim 6, wherein the instrumental fill-in is selected from the group consisting of: drum roll, piano fill, guitar riff, cymbal crash, gong, and tam tam.

10. A method as claimed in claim 4, wherein the corresponding functional aspect is pre-programmed.

11. A method as claimed in claim 4, wherein the corresponding functional aspect is from user input.

12. A method as claimed in claim 4, wherein a predetermined set of black keys have their corresponding functional aspect pre-programmed.

13. A method as claimed in claim 4, wherein all remaining black keys are able to have their corresponding functional aspect input by a user.

14. A computer useable medium comprising a computer program code that is configured to cause a processor to execute one or more of functions to enable a musical keyboard to be used for playing in accordance with a designated scale as claimed in claim 1.

* * * * *